US007713599B2

(12) United States Patent
Watanabe et al.

(10) Patent No.: US 7,713,599 B2
(45) Date of Patent: May 11, 2010

(54) INKJET RECORDING MATERIAL

(75) Inventors: Hiroaki Watanabe, Tokyo (JP); Katsuaki Arai, Tokyo (JP); Yasuro Yokota, Tokyo (JP); Suguru Kashima, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 739 days.

(21) Appl. No.: 10/564,633

(22) PCT Filed: Aug. 24, 2004

(86) PCT No.: PCT/JP2004/012112

§ 371 (c)(1),
(2), (4) Date: Jan. 13, 2006

(87) PCT Pub. No.: WO2005/051670

PCT Pub. Date: Jun. 9, 2005

(65) Prior Publication Data

US 2006/0172093 A1 Aug. 3, 2006

(30) Foreign Application Priority Data

Nov. 25, 2003 (JP) ..... 2003-394439
Feb. 23, 2004 (JP) ..... 2004-046107

(51) Int. Cl.
*B41M 5/00* (2006.01)

(52) U.S. Cl. ..... 428/32.21; 428/32.25; 428/32.26; 428/32.3; 428/32.33; 428/32.35; 428/32.37

(58) Field of Classification Search ..... 428/32.21, 428/32.25, 32.26, 32.3, 32.33, 32.35, 32.37
See application file for complete search history.

(56) References Cited

U.S. PATENT DOCUMENTS 6,187,430 B1 * 2/2001 Mukoyoshi et al. ..... 428/331
6,387,473 B1 * 5/2002 Sismondi et al. ..... 428/32.34
6,495,242 B1 * 12/2002 Tsuchiya et al. ..... 428/32.24
6,511,736 B1 1/2003 Asano et al.
2001/0009712 A1 * 7/2001 Totani et al. ..... 428/195
2002/0034615 A1 3/2002 Otani et al.
2002/0094421 A1 * 7/2002 Quintens et al. ..... 428/195
2002/0182380 A1 * 12/2002 Nagashima et al. ..... 428/195
2003/0072925 A1 * 4/2003 Kiyama et al. ..... 428/195
2003/0104175 A1 6/2003 Koike et al.

FOREIGN PATENT DOCUMENTS

JP 2001-10222 1/2001
JP 2001-334748 12/2001
JP 2002-225423 8/2002
JP 2003-94801 4/2003
JP 2004-9737 1/2004
WO WO02/34541 5/2002
WO WO 02/34541 A1 * 5/2002

OTHER PUBLICATIONS

Chinese Office Action dated Feb. 15, 2008, with English translation.
German Office Action dated Jul. 17, 2008 with English Translation.

* cited by examiner

*Primary Examiner*—Betelhem Shewareged
(74) *Attorney, Agent, or Firm*—Kratz, Quintos & Hanson, LLP

(57) ABSTRACT

The object of the present invention is to provide an ink jet recording material which has no cracks on the surface of the ink-receiving layer and possesses both the color developability and the absorbability of pigment inks. According to the present invention, there is provided an ink jet recording material formed by coating a coating solution of a pigment layer and a coating solution of at least one ink-receiving layer in succession on at least one side of a paper support and drying the resulting coating layers, wherein the pigment contained in the pigment layer has an average secondary particle diameter of not less than 1 μm and not more than 5 μm, 50% by volume or more of the total volume of the pigment has a secondary particle diameter of not less than 1.2 μm and not more than 15 μm, a first ink-receiving layer directly coated on the pigment layer contains at least inorganic ultrafine particles, a hydrophilic binder and boric acid or a borate, and the dry coating amount of the first ink-receiving layer is not less than 20% by mass and not more than 120% by mass of the dry coating amount of the pigment layer.

17 Claims, No Drawings

INKJET RECORDING MATERIAL

TECHNICAL FIELD

The present invention relates to an ink jet recording material, and, more particularly, it relates to an ink jet recording material suitable for recording with a pigment ink.

BACKGROUND ART

Recently, owing to remarkable progress of ink jet printers and plotters, minute images of full color can be easily obtained.

Ink jet recording systems perform recording of images or letters by ejecting ink droplets according to various operational principles and depositing them on recording materials such as paper. The ink jet printers or plotters recently rapidly spread in various uses as apparatuses for making hard copies of image information such as letters and various figures produced by computers. Particularly, color images obtained by multicolor ink jetting systems are not inferior in quality to the recorded images obtained by the multicolor printing according to plate making systems or the color photographic processes. Moreover, when a small number of prints are to be produced, they can produce the prints more cheaply than the printing process or photographic process. Thus, ink jet recording systems are being widely applied to the field of multicolor image recording.

Moreover, with diversification of uses, use of them for preparation of large-sized posters and POP arts and for drafting has increased. In these uses, satisfactory images can be obtained due to utilization of high sharpness and excellent color attainable by ink jet recording, resulting in a high propaganda effect. Application to these uses increases because images excellent in image reproducibility or color reproducibility such as sharpness and colorfulness can be easily obtained on personal computer level, and this is a reason for making much use of ink jet recording materials.

Owing to enhancement of performance and diversification of these ink jet recording apparatuses, needs for ink jet recording increase and, as a result, characteristics and demands required for recording apparatuses and ink jet recording materials are also considerably enhanced. For example, in the case of the uses for large-sized posters or POP arts and the uses for outputting photographic images, these uses are indoor or outdoor displays or personal recording and storage, and, hence, weathering resistance and storage stability of images higher than those of conventional technologies are demanded. For these demands, improvement in inks and ink jet recording materials has been advanced and considerably higher storage stability has been attained. However, light resistance has not yet reached the level of silver salt photography and thus the demands have not yet been satisfied.

In order to satisfy these demands, recently, inks of pigment type are used. It is known that since the pigment inks are less in deterioration by light and do not redissolve in water, weathering resistance and storage stability of the resulting images are higher than those of the images obtained with inks of dye type. However, since the colorant pigment in the inks is insoluble in solvents, being different from dyes, the colorant pigment in the inks must be stably dispersed and the proportion of the colorant pigment in the ink cannot be easily increased. Furthermore, the pigment inks are not so high in coloring efficiency as the dye inks and can hardly give clear colors.

Therefore, naturally the demand for ink jet recording materials also increases. As a method for improving absorbability for pigment ink, it is considered to increase thickness of the ink-receiving layer coated on a support. According to this method, the ink absorbability can be improved, but color developability deteriorates because the ink deeply penetrates in the direction of base paper. As mentioned above, the pigment ink cannot develop clear color as compared with dye ink, and hence in the case of the pigment ink, the color developability is considerably deteriorated when the ink deeply penetrates. Furthermore, the deterioration is further conspicuous in the case of ink jet recording materials having no ink-receiving layer.

For obtaining satisfactory ink jet recording performance, there is proposed an ink jet recording material which contains inorganic ultrafine particles, and there is disclosed an ink jet recording material which uses synthetic silica having a primary particle diameter of 3-30 nm and prepared mainly by a gas phase method (see, for example, Patent Documents 1 and 2). Furthermore, there is disclosed a method of providing a coat containing inorganic ultrafine particles, polyvinyl alcohol and boric acid or a salt thereof on an ink solvent non-absorbent support (see, for example, Patent Documents 3-5). According to this method, the coat can be obtained without causing occurrence of cracking if the dry coating amount of the coat is small, but the coat is low in ink absorbability, and in order to provide a thick coat to improve the ink absorbability, it is necessary that a coating solution is coated after heating the solution to higher than room temperature or the coat is cooled after coating, thereby to set the coating solution on the support to form a firm bond between a viscosity increasing agent and inorganic ultrafine particles or a binder, followed by carrying out drying. Therefore, the production efficiency lowers and besides even if the coat is made thicker, the ink absorbability is sometimes unsatisfactory.

For obtaining an ink jet recording material which aims at attaining both the color developability of pigment ink and the ink absorbability, it is proposed to coat, on an ink solvent non-absorbent support, a first ink-receiving layer containing a gas phase process silica, boric acid or a borate and polyvinyl alcohol and a second ink-receiving layer containing alumina or an alumina hydrate, boric acid or a borate and polyvinyl alcohol in succession (see, for example, Patent Document 6). According to this method, an improvement of ink absorbability can be attained, but it is still insufficient.

For improving the ink absorbability, it may be considered to provide an ink-receiving layer having the above construction on a support having gas permeability and ink solvent absorbability such as a paper support. However, in the case of using an ink solvent non-absorbent support, a binder component or the like in the coat does not fall into the support and, hence, cracking of the coat does not occur while in the case of using a support having ink solvent absorbability such as a paper support, the binder component or the like in the ink-receiving layer falls into the paper support and cracking of the surface of the ink-receiving layer is apt to occur. The cracking of the coating layer becomes conspicuous when an ink-receiving layer comprising a fine particle pigment of several ten nm to several hundred nm in particle diameter is used for the purpose of imparting gloss. There is the problem that when the pigment ink falls into the cracks, color developability lowers to deteriorate the pigment ink characteristics.

In order to enhance color developability and fixability of pigment ink, it is proposed to use an alumina hydrate as a pigment used in the ink-receiving layer (see, for example, Patent Document 7). The color developability and fixability of pigment ink are improved according to this method, but there is a problem that even if a paper support of high absorbability is used, the ink absorbability is insufficient.

On the other hand, there is proposed an ink jet recording material in which a silica porous layer is provided as a lower layer and a layer containing alumina or alumina hydrate is provided as an upper layer or a recording material in which an absorbent layer containing a pigment is provided as a lower layer and a layer containing pseudoboehmite is provided as an upper layer (see, for example, Patent Documents 8 and 9).

When the upper layer containing inorganic ultrafine particles is formed by coating a coating solution of the upper layer on a lower layer comprising porous silica and drying the coat, the inorganic ultrafine particle component or the like in the upper layer falls into the lower layer. As a result, cracking of the surface of the upper layer is apt to occur to cause reduction of surface gloss, and, furthermore, when a dye ink is used in ink jet recording, ink absorbability is improved due to many cracks, but in the case of using a pigment ink lower in color developability than the dye ink, the pigment ink falls into the cracks, which may cause deterioration of pigment ink characteristics.

Furthermore, an ink jet recording material is proposed which comprises an undercoat layer containing a basic material provided for improving color developability of ink and a porous image receiving layer comprising fumed alumina provided on the undercoat layer (see, for example, Patent Document 10).

However, since the undercoat layer containing a basic material comprises only a polymer component such as gelatin, the polymer component is swollen with water contained in the porous image receiving layer during coating of the porous image receiving layer, and strain occurs during drying of the porous image receiving layer, which may cause cracking of the porous image receiving layer and reduction of gloss and deterioration of the pigment ink characteristics.

[Patent Document 1] JP-A-10-203006 (pages 3-9)
[Patent Document 2] JP-A-8-174992 (pages 3-6)
[Patent Document 3] JP-A-7-76161 (pages 2-3)
[Patent Document 4] JP-A-10-193777 (pages 2-10)
[Patent Document 5] JP-A-2002-2094 (pages 2-10)
[Patent Document 6] JP-A-2002-225423 (pages 2-7)
[Patent Document 7] JP-A-2002-79748 (pages 2-4)
[Patent Document 8] JP-A-6-55829 (pages 2-3)
[Patent Document 9] JP-A-7-89216 (pages 2-6)
[Patent Document 10] JP-A-2002-331746 (pages 3-5)

DISCLOSURE OF INVENTION

Problem to be Solved by the Invention

The object of the present invention is to provide an ink jet recording material which has both the high ink absorbability for pigment inks and the high color developability with causing no cracking of the surface of ink-receiving layer.

Means for Solving the Problem

As a result of intensive research conducted by the inventors in an attempt to attain the above object, the problem has been solved by an ink jet recording material formed by coating successively a coating solution of a pigment layer and a coating solution of at least one ink-receiving layer on at least one side of a paper support, followed by drying the resulting coats, wherein the pigment contained in the pigment layer has an average secondary particle diameter of not less than 1 μm and not more than 5 μm, 50% by volume or more of the total volume of the pigment has a secondary particle diameter of not less than 1.2 μm and not more than 15 μm, a first ink-receiving layer directly coated on the pigment layer contains at least inorganic ultrafine particles, a hydrophilic binder and boric acid or a borate, and the dry coating amount of the first ink-receiving layer is not less than 20% by mass and not more than 120% by mass of the dry coating amount of the pigment layer.

It is preferred that the pigment has an oil absorption of not less than 160 ml/100 g and not more than 320 ml/100 g in accordance with JIS K5101.

It is preferred that the coating solution of the pigment layer has a pH of not less than 8 and not more than 11, and the coating solution of the first ink-receiving layer has a pH of not less than 3 and not more than 5.

It is preferred that the inorganic ultrafine particles contained in the first ink-receiving layer comprise an alumina hydrate, and it is more preferred that the second ink-receiving layer coated on the first ink-receiving layer contains an alumina hydrate as the inorganic ultrafine particles.

It is preferred that the inorganic ultrafine particles contained in the first ink-receiving layer are gas phase process silica and/or wet process silica which is ground until the average secondary particle diameter reaches 500 nm or less, it is more preferred that the second ink-receiving layer coated on the first ink-receiving layer contains an alumina hydrate as the inorganic ultrafine particles, and it is especially preferred that the gas phase process silica or wet process silica contained in the first ink-receiving layer has a specific surface area according to BET process which is smaller than that of the alumina hydrate contained in the second ink-receiving layer.

It is preferred that at least one ink-receiving layer contains a basic polyaluminum hydroxide.

It is preferred that at least one ink-receiving layer other than the first ink-receiving layer contains boric acid or a borate.

It is preferred that the ink jet recording material has a 75° specular gloss of not less than 55% and not more than 80% in accordance with JIS P8142.

ADVANTAGES OF THE INVENTION

Since the ink jet recording material of the present invention has no cracks on the surface of the ink-receiving layer, the pigment ink does not fall into the cracks and the ink jet recording material can have both the high absorbability and the high color developability.

BEST MODE FOR CARRYING OUT THE INVENTION

The ink jet recording material of the present invention will be explained in detail below.

In order to improve suitability for pigment inks, the inventors have considered that high absorbability and color developability can be attained by separating the solvent and the colorant pigment in a pigment ink and distributing the colorant pigment in the vicinity of the surface of the ink-receiving layer and penetrating the solvent component into the ink-receiving layer.

In the ink jet recording material of the present invention, it is important that cracking of the coating layer is inhibited as far as possible in providing each ink-receiving layer in order to improve color developability of the pigment ink by distributing the colorant pigment contained in the pigment ink in the vicinity of the surface of the ink-receiving layer. Therefore, as a result of intensive research conducted by the inventors on inhibition of cracking of the surface of the ink-receiving layer and separation of the colorant pigment component and the solvent component in the pigment ink, it has been found that it becomes possible to provide an ink-receiving layer free from cracks on the pigment layer, and an ink jet recording material having both high absorbability for pigment ink and high color developability of the pigment ink can be produced by effectively separating the pigment ink into a colorant pigment and a solvent component, efficiently absorbing the separated solvent component in the ink-receiving layer and distributing the colorant pigment in the vicinity of the surface of the ink-receiving layer when a paper support having gas permeability and ink solvent absorbability is used as a support, the pigment contained in the pigment layer has an average secondary particle diameter of not less than 1 μm and not more than 5 μm, 50% by volume or more of the total volume of the pigment has a secondary particle diameter of not less than 1.2 μm and not more than 15 μm, a first ink-receiving layer directly coated on the pigment layer contains at least inorganic ultrafine particles, a hydrophilic binder and boric acid or a borate, and the dry coating amount of the first ink-receiving layer is not less than 20% by mass and not more than 120% by mass of the dry coating amount of the pigment layer.

The pigment ink in the present invention is a recording solution comprising a colorant pigment, a dispersion solvent and other additives and is not particularly limited. The dispersion solvent may be any of water and various organic solvents.

In the ink jet recording material of the present invention, a paper support having gas permeability and ink solvent absorbability is used as a support. The paper support in the present invention is a base paper prepared by mixing a wood pulp, for example, a chemical pulp such as LBKP or NBKP, a mechanical pulp such as GP, PGW, RMP, TMP, CTMP, CMP or CGP, or a wastepaper pulp such as DIP and a known pigment as main components with binder and sizing agent and at least one of various additives such as fixing agent, yield improving agent, cationizing agent or strengthening agent and making a paper from the mixture using various apparatuses such as Fourdriner paper machine, cylinder paper machine and twin-wire paper machine. Furthermore, the base paper may be subjected to size press coating with starch, polyvinyl alcohol or the like.

The pigment layer provided in the present invention will be explained below. In the ink jet recording material of the present invention, there is provided on a paper support a pigment layer containing a pigment which has an average secondary particle diameter of not less than 1 μm and not more than 5 μm and in which 50% by volume or more of the total volume of the pigment has a secondary particle diameter of not less than 1.2 μm and not more than 15 μm.

In the present invention, the secondary particles are particles formed by agglomeration of fine primary particles and present in the state of dispersion, and in the case of monodispersed particles, the secondary particle diameter means the diameter of the dispersed particles.

Furthermore, in the present invention, "% by volume" shows a proportion of the whole volume of pigment particles having a particle diameter within a specified range in the total volume of the pigment particles contained in the pigment layer. The average secondary particle diameter and % by volume are obtained from the particle size distribution data measured by a particle size distribution meter using laser beam diffraction•scattering method.

The average secondary particle diameter of the pigment used in the pigment layer of the present invention is not less than 1 μm and not more than 5 μm, preferably not less than 1 μm and not more than 4 μm, and especially preferably not less than 1.2 μm and not more than 3 μm. If the average secondary particle diameter of the pigment is less than 1 μm, much pigment in the pigment layer falls into the paper support, and the pigment layer cannot sufficiently inhibit the falling of the binder component or the like contained in the ink-receiving layer during coating of the coating solution of the first ink-receiving layer, and, as a result, the ink-receiving layer is apt to crack. If the average secondary particle diameter of the pigment is more than 5 μm, smoothness of the pigment layer is deteriorated, and, hence, satisfactory surface gloss cannot be obtained even when the ink-receiving layer of the present invention is provided on the pigment layer. Moreover, the void between particles becomes too large, and the pigment layer cannot sufficiently inhibit the falling of the binder component contained in the ink-receiving layer, and, as a result, the ink-receiving layer is apt to crack.

In the pigment particles contained in the pigment layer, 50% by volume or more of the total volume of the pigment particles have a secondary particle diameter of not less than 1.2 μm and not more than 15 μm. In order to improve the gloss of the surface of the ink-receiving layer and color developability with maintaining the ink absorbability, it is more preferred that 50% by volume or more of the total volume of the pigment particles contained in the pigment layer have a secondary particle diameter of not less than 1.5 μm and not more than 10 μm. More preferably, 65% by volume or more of the total volume of the pigment particles contained in the pigment layer comprise those having a secondary particle diameter of not less than 1.5 μm and not more than 10 μm. Within this range, the inorganic ultrafine particles contained in the ink-receiving layer can be inhibited from falling into the lower layer and the ink absorbability can be more efficiently obtained without causing occurrence of cracks on the surface of the ink-receiving layer.

The pigment contained in the pigment layer has an oil absorption (measured in accordance with JIS K5101) of preferably not less than 160 ml/100 g and not more than 320 ml/100 g, more preferably not less than 170 ml/100 g and not more than 300 ml/100 g, and further preferably not less than 190 ml/100 g and not more than 280 ml/100 g. Within this range, when the ink-receiving layer is coated, water in the coating solution of the ink-receiving layer is properly absorbed and, hence, thickening effect due to increase in concentration of the coating solution of the ink-receiving layer is obtained, by which the inorganic ultrafine particles contained in the ink-receiving layer are inhibited from falling into the lower layer and occurrence of cracks on the surface of the ink-receiving layer can be inhibited, resulting in improvement of ink absorbability.

In order to control the permeability of the coating solution of the first ink-receiving layer into the pigment layer and inhibit cracking of the ink-receiving layer, the gas permeability (specified in JIS P8117) in the state of the pigment layer being provided on a paper support is preferably not less than 30 seconds and not more than 1000 seconds, more preferably not less than 50 seconds and not more than 300 seconds.

As pigments used in the pigment layer of the present invention, there may be used at least one known white pigment. Examples of the pigments are inorganic white pigments such as precipitated calcium carbonate, heavy calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, aluminum hydroxide, alumina, lithopone, zeolite, hydrated halloysite, magnesium carbonate and magnesium hydroxide, and organic pigments such as styrenic plastic pigments, acrylic plastic pigments, polyethylene, urea resins and melamine resins. Of these pigments, porous inorganic pigments are preferred from the point of balancing between cracking of coating layers and ink absorbability, and examples thereof are porous synthetic amorphous silica, porous calcium carbonate, porous magnesium carbonate, porous alumina, and the like, and porous synthetic amorphous silica is particularly preferred.

In case two or more of different kind of pigment particles or two or more of the same kind of pigment particles differing in properties such as average secondary particle diameter and oil absorption are used as the pigments contained in the pigment layer, when the oil absorption of the mixed pigment particles is within the above-mentioned range, the ink absorbability can be more efficiently obtained without causing occurrence of cracking on the surface of the ink-receiving layer.

In the present invention, in addition to the pigment particles, the pigment layer can contain adhesives and furthermore cationic compounds when the recording material is applied to ink jet recording method using both the pigment ink and the dye ink. Moreover, there may be optionally added additives such as dye fixing agents, pigment dispersing agents, thickening agents, fluidity improving agents, surface active agents, anti-foaming agents, foam inhibitors, releasing agents, foaming agents, penetrants, colored dyes, colored pigments, fluorescent brighteners, ultraviolet absorbers, antioxidants, preservatives, antifungal agents, water resisting agents, wet strengthening agents, and dry strengthening agents.

The pigment layer of the present invention preferably further contains a binder. As the binder, mention may be made of, for example, starch derivatives such as oxidized starch, etherified starch and phosphoric acid esterified starch; cellulose derivatives such as methyl cellulose, carboxymethyl cellulose and hydroxyethyl cellulose; polyvinyl alcohol or polyvinyl alcohol derivatives such as silanol-modified polyvinyl alcohol; natural polymer resins or derivatives thereof such as casein, gelatin and modification products thereof, soybean protein, pullulan, gum arabic, karaya gum and albumin; hydrophilic binders such as vinyl polymers, for example, polyacrylamide and polyvinyl pyrrolidone, alginic acid, polyethyleneimine, polypropylene glycol, polyethylene glycol, maleic anhydride and copolymers thereof; latex binders, for example, conjugated diene copolymer latexes such as styrene-butadiene copolymer and methyl methacrylate-butadiene copolymer, acrylic polymer latexes such as polymers or copolymers of acrylate esters and methacrylate esters, vinyl copolymer latexes such as ethylene-vinyl acetate copolymer and vinyl chloride-vinyl acetate copolymer, polyurethane resin latexes, alkyd resin latexes, unsaturated polyester resin latexes, and functional group-modified copolymer latexes of the above-mentioned copolymers which are modified with monomers containing functional groups such as carboxyl group; aqueous adhesives, for example, thermosetting synthetic resins such as melamine resin and urea resin, and polyvinyl butyral. One or more of these binders can be used. Of these binders, use of one or more of the hydrophilic binders and one or more of latex binders is preferred from the points of coating layer strength and cracking of coating layer.

The amount of the binder used in the pigment layer of the present invention is 5-70 parts by mass, preferably 10-50 parts by mass based on 100 parts by mass of the pigment particles in total.

In the present invention, the dry coating amount of the pigment layer is 3-30 g/m$^2$, more preferably 5-20 g/m$^2$ Within this range of the dry coating amount of the pigment layer, the ink absorbability can be more efficiently obtained without causing reduction of gloss.

Next, the ink-receiving layer of the present invention will be explained. The ink jet recording material of the present invention comprises a first ink-receiving layer which is directly coated on the pigment layer and contains inorganic ultrafine particles, a hydrophilic binder and boric acid or a borate, the dry coating amount of the first ink-receiving layer being not less than 20% by mass and not more than 120% by mass of the dry coating amount of the pigment layer, and, if necessary, additionally at least one ink-receiving layer, which are laminated in succession. According to this construction, there occurs no cracking of the surface of the coating layer and both the high color developability of the pigment ink and the ink absorbability can be attained.

The inorganic ultrafine particles in the ink jet recording material of the present invention are inorganic fine particles having an average secondary particle diameter of not more than 500 nm in case primary particles agglomerate to form secondary particles. In the case of the particles being in the monodispersed state, the inorganic ultrafine particles are inorganic fine particles having an average primary particle diameter of not more than 500 nm. As representative examples thereof, mention may be made of alumina hydrates such as pseudoboehmite disclosed in JP-A-1-97678, JP-A-2-275510, JP-A-3-281383, JP-A-3-285814, JP-A-3-285815, JP-A-4-92183, JP-A-4-267180, JP-A-4-275917, etc., gas phase process alumina disclosed in JP-A-8-72387, colloidal silica disclosed in JP-A-60-219083, JP-A-61-19389, JP-A-61-188183, JP-A-63-178074, JP-A-5-51470, etc., silica/alumina hybrid sols disclosed in JP-B-4-19037, JP-A-62-286787, etc., silica sols prepared by dispersing gas phase process silica by a high-speed homogenizer which are disclosed in JP-A-10-119423, JP-A-10-217601, etc., wet process silica ground to less than 500 nm in average secondary particle diameter, smectite clays such as hectorite and montmorillonite (JP-A-7-81210), zirconia sol, chromia sol, yttria sol, ceria sol, iron oxide sol, zircon sol, aluminum oxide sol, antimony oxide sol, and the like.

The average primary particle diameter of the inorganic ultrafine particles in the present invention is an average particle diameter obtained using as a particle diameter the diameter of a circle having an area equal to a projected area of each of 100 primary particles present in a given area by observation with an electron microscope, and the average secondary particle diameter of the inorganic ultrafine particles is obtained by carrying out measurement by a particle diameter distribution meter using a laser diffraction•scattering method on a diluted dispersion.

As the inorganic ultrafine particles contained in the first ink-receiving layer of the present invention, an alumina hydrate is preferred among the above-enumerated inorganic ultrafine particles. When an alumina hydrate is used, cracking hardly occurs on the surface of the ink-receiving layer and, furthermore, separation performance between the colorant pigment and the solvent component in the pigment ink is improved.

The alumina hydrate used in the present invention can be represented by the general formula $Al_2O_3.nH_2O$. The alumina hydrates can be classified into gibbsite, bialite, norstrandite, boehmite, boehmite gel (pseudoboehmite), diaspore, amorphous alumina hydrate, etc. depending on the composition or crystal form. In the above formula, when n is 1, the formula shows an alumina hydrate of boehmite structure, when n is more than 1 and less than 3, the formula shows an alumina hydrate of pseudoboehmite, and when n is 3 or more, the formula shows an alumina hydrate of amorphous structure. The alumina hydrate especially preferred for the present invention is an alumina hydrate of pseudoboehmite structure where n is more than 1 and less than 3.

Furthermore, for stabilizing the dispersion of alumina hydrate, various acids are usually added to the dispersion. Examples of these acids are nitric acid, hydrochloric acid, hydrobromic acid, acetic acid, formic acid, ferric chloride, aluminum chloride, etc., which do not limit the present invention.

The shape of the alumina hydrate used in the present invention may be any of platy shape, fibrous shape, acicular shape, spherical shape and rod-like shape, and the platy shape is preferred from the point of ink absorbability. The platy alumina hydrate has an average aspect ratio of 3-8, preferably 3-6. The aspect ratio is a ratio of "diameter" to "thickness" of the particles. The diameter of the particles here is a diameter of a circle having an area equal to a projected area of the particle when observed by an electron microscope.

The alumina hydrate used in the present invention can be produced by known methods such as hydrolysis of an aluminum alkoxide such as aluminum isopropoxide, neutralization of an aluminum salt with an alkali, and hydrolysis of an aluminate. The physical properties of the alumina hydrate such as particle diameter, pore diameter, pore volume and specific surface area can be controlled by the conditions such as precipitation temperature, aging temperature, aging time, pH of solution, concentration of solution and coexisting compounds.

As a method for obtaining the alumina hydrate from an alkoxide, JP-A-57-88074, JP-A-62-56321, JP-A-4-275917, JP-A-6-64918, JP-A-7-10535, and JP-A-7-267633, and U.S. Pat. No. 2,656,321 disclose hydrolysis of an aluminum alkoxide. Examples of the aluminum alkoxide are isopropoxide and 2-butoxide.

The alumina hydrate used in the present invention has an average primary particle diameter of preferably 3-25 nm, and especially preferably 5-20 nm. The average secondary particle diameter of linked particles is preferably 50-200 nm.

Gas phase process silica and/or wet process silica ground until the average secondary particle diameter reaches 500 nm or less are preferred as the inorganic ultrafine particles contained in the first ink-receiving layer of the present invention. The gas phase process silica is especially preferred. The gas phase process silica is also called dry process silica and generally prepared by a flame hydrolysis method. Specifically, a method of burning silicon tetrachloride together with hydrogen and oxygen is generally known, and a silane such as methyltrichlorosilane or trichlorosilane alone or in admixture with silicon tetrachloride may be used in place of silicon tetrachloride. The gas phase process silica is commercially available as AEROSIL from Japan Aerosil Co., Ltd. and QS Type from Tokuyama Co., Ltd.

The average primary particle diameter of gas phase process silica used in the present invention is preferably 5-50 nm, more preferably 10-40 nm, and especially preferably 15-30 from the points of cracking of the first ink-receiving layer, the surface gloss and the color development of the pigment ink. The specific surface area measured by BET method is preferably not less than 30 $m^2/g$ and not more than 300 $m^2/g$, especially preferably not less than 40 $m^2/g$ and not more than 150 $m^2/g$ from the points of cracking and ink absorbability of the first ink-receiving layer. The BET method in the present invention is one of the methods for measuring the surface area of powders according to gas phase adsorption method and a method for obtaining total surface area of 1 g of a sample from an adsorption isotherm, namely, for obtaining a specific surface area. Generally, nitrogen gas is used as the adsorption gas, and most frequently employed is a method of measuring an adsorption amount from the change of pressure or volume of the gas to be adsorbed. The Brunauer, Emmett, Teller's formula is the most famous for representing an isotherm of polymolecular adsorption, and is called BET formula and widely used for determination of surface area. An adsorption amount is obtained according to the BET formula and is multiplied by the area occupied by one adsorbed molecule on the surface to obtain a surface area.

For the first ink-receiving layer of the present invention, there may be used a dispersion obtained by dispersing the gas phase process silica in the presence of a cationic compound so as to give an average secondary particle diameter of the silica of not more than 500 nm, preferably 50-400 nm, further preferably 100-300 nm. The dispersion is preferably carried out by premixing the gas phase process silica, the cationic compound and a dispersion medium by a usual propeller stirring, turbine type stirring, homomixer type stirring, etc. and then carrying out dispersion using a media mill such as ball mill, beads mill or sand grinder, a pressure type dispersing machine such as high pressure homogenizer or ultrahigh pressure homogenizer, an ultrasonic dispersing machine, a thin film pivoted type dispersing machine, or the like.

The wet process silica used in the first ink-receiving layer of the present invention is classified into precipitation process silica and gel process silica depending on the production process. The precipitation process silica is produced by reacting sodium silicate and sulfuric acid under alkaline condition, and is made to commercial products by agglomerating and precipitating the grown silica particles and then subjecting to filtration, water washing, drying, grinding and classification. The precipitation process silica is commercially available, for example, as NIPSIL from Tosoh Silica Co., Ltd. and as TOKUSIL from Tokuyama Co., Ltd. The gel process silica is produced by reacting sodium silicate and sulfuric acid under acidic condition. Since the fine particles dissolve and reprecipitate to link other primary particles with each other during aging, distinct primary particles disappear to form relatively hard agglomerated particles having internal void structure. The gel process silica is commercially available, for example, as NIPGEL from Tosoh Silica Co., Ltd. and as SYLOID and SYLOJET from Grace Japan Co., Ltd.

In the present invention, there is used wet process silica ground to not more than 500 nm in average secondary particle size. The wet process silica particles used in the present invention are preferably those which have an average primary particle diameter of not more than 50 nm, preferably 3-40 nm and an average agglomeration particle diameter of 5-50 μm, and there are used wet process silica fine particles obtained by finely grinding the above wet process silica particles to not more than 500 nm, preferably 50-400 nm in average secondary particle diameter in the presence of a cationic compound.

The wet process silica produced by usual process has an average agglomeration particle diameter of 1 μm or more, and, hence, is finely ground for use. As the grinding method, there may be preferably used a wet dispersion method which comprises mechanically grinding silica dispersed in an aqueous medium. In this case, it is preferred to use a precipitation process silica having an oil absorption of 210 ml/100 g or less and an average agglomeration particle diameter of 5 μm or more because increase of initial viscosity of the dispersion can be inhibited, dispersion in high concentration becomes possible, grinding and dispersing efficiency is enhanced, and the silica can be ground to finer particles. By using a dispersion of high concentration, the productivity of recording papers is also improved. The oil absorption is measured in accordance with JIS K5101.

As a specific method for obtaining fine particles of wet process silica having an average secondary particle diameter of 500 nm or less of the present invention, first the silica particles and a cationic compound may be mixed in water (the silica particles and the cationic compound may be added in any order and they may be added simultaneously) or a dispersion or an aqueous solution of each of the silica particles and the cationic compound may be mixed, and a preliminary dispersion is obtained using at least one of dispersing apparatuses such as a serrated blade type dispersing machine, a propeller blade type dispersing machine and a rotor stator type dispersing machine. If necessary, a moderately low-boiling solvent and the like may further be added. The higher solid concentration of the silica preliminary dispersion is preferred, but if the concentration is too high, dispersion becomes impossible and the concentration is preferably 15-40% by mass, more preferably 20-35% by mass. Then, by subjecting the dispersion to stronger mechanical means, there is obtained a dispersion of wet process silica fine particles having an average secondary particle diameter of not more than 500 nm. The mechanical means include known methods using, for example, a media mill such as ball mill, beads mill or sand grinder, a pressure type dispersing machine such as high pressure homogenizer or ultrahigh pressure homogenizer, an ultrasonic dispersing machine, a thin film pivoted type dispersing machine, or the like.

Cationic polymers or water-soluble metal compounds can be used as the cationic compounds used for dispersing the gas phase process silica and wet process silica. The cationic polymers are preferably polyethyleneimine, polydiallylamine, polyallylamine, alkylamine polymers, and polymers having a primary to tertiary amino groups or quaternary ammonium bases disclosed in JP-A-59-20696, JP-A-59-33176, JP-A-59-33177, JP-A-59-155088, JP-A-60-11389, JP-A-60-49990, JP-A-60-83882, JP-A-60-109894, JP-A-62-198493, JP-A-63-49478, JP-A-63-115780, JP-A-63-280681, JP-A-1-40371, JP-A-6-234268, JP-A-7-125411, JP-A-10-193776, etc. Diallylamine derivatives are particularly preferred as the cationic polymers. From the points of dispersibility and viscosity of dispersion, the molecular weight of these cationic polymers is preferably about 2,000 to 100,000, especially preferably about 2,000 to 30,000.

As the water-soluble metal compounds, mention may be made of, for example, water-soluble polyvalent metal salts, and preferred are compounds comprising aluminum or a metal of Group 4A in the periodic table (e.g., zirconium or titanium). Especially preferred are water-soluble aluminum compounds. As the water-soluble aluminum compounds, there are known, for example, inorganic salts such as aluminum chloride or hydrates thereof, aluminum sulfate or hydrates thereof, ammonium alum, and the like. Furthermore, basic polyaluminum hydroxide compounds which are inorganic aluminum cation-containing polymers are known and preferred.

In the present invention, when a second ink-receiving layer is provided, preferably, it contains an alumina hydrate as inorganic ultrafine particles. In the case of using an alumina hydrate, higher surface gloss and higher gloss of the printed images are obtained, and color developability of the pigment ink is satisfactory. There may be used the same alumina hydrate as used in the first ink-receiving layer.

In the present invention, when the ink-receiving layer comprises a plurality of layers, and gas phase process silica or wet process silica is used in the first ink-receiving layer and an alumina hydrate is used in the second ink-receiving layer, it is preferred that the gas phase process silica or wet process silica used in the first ink-receiving layer has a specific surface area according to BET method which is smaller than that of the alumina hydrate used in the second ink-receiving layer. By employing such construction, when the second ink-receiving layer is provided on the first ink-receiving layer, occurrence of cracking of the coating layer is further inhibited and satisfactory color developability of the pigment ink can be readily obtained. This is probably because the specific surface area according to BET method of the gas phase process silica or wet process silica used in the first ink-receiving layer is smaller than that of the alumina hydrate used in the second ink-receiving layer, and, hence, less binder component or the like in the second ink-receiving layer falls into the first ink-receiving layer, causing substantially no adverse effect on the ink absorbability and substantially no cracking of the ink-receiving layer.

In the present invention, the gas phase process silica and the wet process silica ground to not more than 500 nm in average secondary particle diameter may be used each alone or in combination in the first ink-receiving layer, and the content of the gas phase process silica or the ground wet process silica in the first ink-receiving layer (total content when they are used in combination) is preferably not less than 50% by mass, more preferably not less than 70% by mass, especially preferably not less than 80% by mass based on the total solid content in the first ink-receiving layer. Furthermore, the content of the alumina hydrate in the first or second ink-receiving layer is preferably not less than 50% by mass, more preferably not less than 70% by mass, especially preferably not less than 80% by mass based on the total solid content in the first or second ink-receiving layer.

In each ink-receiving layer of the present invention, there are used hydrophilic binders which maintain characteristics as a film and are high in transparency and high in penetration of ink. As the hydrophilic binders, mention may be made of, for example, starch derivatives such as oxidized starch, etherified starch and phosphoric acid esterified starch; cellulose derivatives such as methyl cellulose, carboxymethyl cellulose and hydroxyethyl cellulose; polyvinyl alcohol or polyvinyl alcohol derivatives such as silanol-modified polyvinyl alcohol; natural polymer resins or derivatives thereof such as casein, gelatin and modification products thereof, soybean protein, pullulan, gum arabic, karaya gum and albumin; vinyl polymers such as polyacrylamide and polyvinyl pyrrolidone; alginic acid, polyethyleneimine, polypropylene glycol, polyethylene glycol, maleic anhydride or copolymers thereof, and these may be used each alone or in combination. The present invention is not limited to these binders. The polyvinyl alcohol or polyvinyl alcohol derivatives such as silanol-modified polyvinyl alcohol are preferred from the points of adhesiveness and film formability. Of the polyvinyl alcohols, preferred are polyvinyl alcohols having a saponification degree of not less than 80%, and more preferred are those having a saponification degree of not less than 88% and less than 96% from the points of adjustment of viscosity and film formability of the coating solution. The average polymerization degree is preferably not less than 2000, and especially preferably not less than 3000.

The amount of these hydrophilic binders is preferably 3-25% by mass, especially preferably 4-20% by mass in total dry solid content from the points of cracking of coating layer and ink absorbability. When two ink-receiving layers are provided, the amount of binders is preferably 8-25% by mass, especially preferably 10-20% by mass in the first ink-receiving layer and is preferably 3-15% by mass, especially preferably 4-10% by mass in the second ink-receiving layer.

The boric acid used in the first ink-receiving layer includes not only orthoboric acid, but also metaboric acid, hypoboric acid or the like. The borates are preferably soluble salts of the boric acid, and specific examples thereof are $Na_4B_4O_7.10H_2O$, $NaBO_2.4H_2O$, $K_2B_4O_7.5H_2O$, $NH_4HB_4O_7.3H_2O$, $NH_4BO_2$, and the like. The present invention is not limited to these borates. Furthermore, when two or more ink-receiving layers are provided, it is preferred that at least one ink-receiving layer other than the first ink-receiving layer contains boric acid or a borate.

The amount of boric acid or borate in terms of $H_3BO_3$ is 1-15% by mass, preferably 3-10% by mass with respect to the hydrophilic binder contained in the ink-receiving layer to which the boric acid or borate is added.

In the present invention, in order to efficiently carry out separation of the colorant pigment and the solvent component in the ink by the ink-receiving layer, the dry coating amount of the first ink-receiving layer is not less than 20% by mass and not more than 120% by mass, more preferably not less than 40% by mass and not more than 100% by mass of the dry coating amount of the pigment layer.

The ink-receiving layer of the present invention can further contain a cationic compound for enhancing fixability and water resistance of the pigment ink and the dye ink. As the cationic compounds, there may be used the compounds exemplified as the cationic compounds used for dispersion of gas phase process silica and wet process silica. Among them, basic polyaluminum hydroxide is preferred because cracking of coating layer hardly occurs, and separation performance between the colorant pigment and the solvent component in the pigment ink is improved, resulting in satisfactory color developability. The basic polyaluminum hydroxide is preferably contained in at least one layer of the ink-receiving layers, and especially preferably contained in the uppermost ink-receiving layer for fixing the pigment ink or the dye ink on the surface of the ink-receiving layer.

The basic polyaluminum hydroxide is a water-soluble polyaluminum hydroxide having a main component represented by the following general formulas (1), (2) or (3) and stably containing a basic and polymeric polynuclear condensation ion, such as, for example, $[Al_6(OH)_{15}]^{3+}$, $[Al_8(OH)_{20}]^{4+}$, $[Al_{13}(OH)_{34}]^{5+}$, $[Al_{21}(OH)_{60}]^{3+}$, or the like.

$$[Al_2(OH)_nCl_{6-n}]_m \quad (1)$$

$$[Al(OH)_3]_nAlCl_3 \quad (2)$$

$$Al_n(OH)_mCl_{(3n-m)} \quad (3)$$

(in the above formulas, m is an integer satisfying the relation $0<m<3n$).

They are commercially available in the name of polyaluminum chloride (PAC) from Taki Chemical Co., Ltd., polyaluminum hydroxide (Paho) from Asada Kagaku Co., Ltd., and PURACHEM WT from Riken Green Co., Ltd., and those of various grades are easily available.

In the present invention, the content of the basic polyaluminum hydroxide in the ink-receiving layer is 0.1-5 g/m$^2$, preferably 0.2-3 g/m$^2$.

Furthermore, so long as attainment of the object of the present invention is not hindered, the ink-receiving layer of the present invention may contain other additives such as cationic dye fixing agents, pigment dispersing agents, thickening agents, fluidity improving agents, viscosity stabilizers, pH adjustors, surface active agents, anti-foaming agents, foam inhibitors, releasing agents, foaming agents, penetrants, colored dyes, colored pigments, fluorescent brighteners, ultraviolet absorbers, antioxidants, leveling agents, preservatives, antifungal agents, water resisting agents, dry strengthening agents, and wet strengthening agents.

In the present invention, the dry coating amount of each ink-receiving layer is not particularly limited, and is preferably 3-16 g/m$^2$, more preferably 5-12 g/m$^2$ from the viewpoints of ink absorbability and cracking of the coating layer.

The pH value of the coating solution of the pigment layer in the present invention is preferably not less than 8 and not more than 11, and that of the coating solution of the first ink-receiving layer is preferably not less than 3 and not more than 5. The pH value of the coating solution of the pigment layer is more preferably not less than 8.5 and not more than 11, and that of the coating solution of the first ink-receiving layer is more preferably not less than 3 and not more than 4.5. Within the above ranges, less binder or inorganic ultrafine particles in the ink-receiving layer fall into the pigment layer, and the surface gloss is improved.

In the coating solution of the pigment layer, there may be used any basic materials as far as they suit for the coating solution of the pigment layer, and by adding them to the coating solution of the pigment layer, pH of the coating solution is suitably adjusted. The basic materials used include, for example, hydroxides such as aluminum hydroxide and sodium hydroxide, carbonic acid compounds such as sodium carbonate, amine compounds, ammonia, etc.

In the coating solution of the ink-receiving layer, there may be used any acidic materials as far as they suit for the coating solution of the ink-receiving layer, and by adding them to the coating solution of the ink-receiving layer, pH of the coating solution is suitably adjusted. The acidic materials used include, for example, inorganic acids or organic acids such as nitric acid, hydrochloric acid, hydrobromic acid, acetic acid, formic acid, lactic acid, citric acid, ferric chloride, and aluminum chloride.

The pigment layer and the ink-receiving layer are formed by coating the respective coating solutions in succession on a support, followed by drying. The method for coating the respective layers is not particularly limited and known coating methods can be employed. For example, the layers can be coated by various apparatuses such as air knife coater, curtain coater, slide lip coater, die coater, blade coater, gate roll coater, bar coater, rod coater, roll coater, bill blade coater, short dwell blade coater, and size press.

The method for drying after coating of the coating solution is not particularly limited, and known drying methods can be employed. Especially, methods of drying by heating, such as a method of blowing hot air and a method of irradiation with infrared rays, are high in productivity and preferred.

Further, the pigment layer or ink-receiving layer may be smoothed by calendering treatment after drying for the purpose of control of smoothing or further improving the surface gloss. In this case, the calendering apparatuses include gloss calender, super calender, soft calender, etc. Furthermore, a gloss surface can be formed using a known cast coating method.

The 75° specular gloss of the ink jet recording material of the present invention measured by JIS-P8142 is preferably not lower than 55% and not higher than 80%, more preferably not lower than 60% and not higher than 80%, and especially preferably not lower than 65% and not higher than 80%. Thus, an ink jet recording material high in gloss can be easily obtained.

EXAMPLES

The present invention will be explained by the following examples, which should not be construed as limiting the invention in any manner. All "part" and "%" in the examples are part by mass and % by mass unless otherwise notified.

In the coating solution of the pigment layer used in the examples, the average secondary particle diameter of the pigment contained in the pigment layer and the proportion of the pigment particles having a secondary particle diameter of not less than 1.2 μm and not more than 15 μm in the total volume of the pigment particles were measured by a laser beam diffraction•scattering method (MICROTRACK 9320HRA manufactured by Leeds & Northrup Co., Ltd.).

The oil absorption of the pigment particles used in the pigment layer was measured in accordance with the method of JIS K5101.

<Support 1>

100 parts of a wood pulp comprising 70 parts of LBKP having a freeness of 450 ml CSF and 30 parts of NBKP having a freeness of 450 ml CSF, 5 parts of a pigment comprising precipitated calcium carbonate/heavy calcium carbonate/talc at a ratio of 30/35/35, 0.1 part of a commercially available alkyl ketene dimmer, 0.03 part of a commercially available cationic acrylamide, 1.0 part of a commercially available cationized starch and 0.5 part of aluminum sulfate were mixed with water to prepare a slurry. The resulting slurry was subjected to paper making process using a Fourdrinier paper machine to make a paper of 105 g/m$^2$ in basis weight, thereby obtaining a support 1 which was a paper support having gas permeability and ink solvent absorbability.

<Pigment Layer Coating Solution 1>

100 parts of a synthetic amorphous silica (average secondary particle diameter: 1.2 μm, oil absorption: 180 ml/100 g, and proportion of inorganic particles having a secondary particle diameter of 1.2-15 μm: 50% by volume) was dispersed in 400 parts of water using a homogenizer, and the dispersion was mixed with 250 parts of a 10% aqueous solution of polyvinyl alcohol (completely saponified and having a polymerization degree of 1700) to prepare a pigment layer coating solution 1 having a solid concentration of 16.7% and a pH of 6.4.

<Pigment Layer Coating Solution 2>

100 parts of a synthetic amorphous silica (average secondary particle diameter: 1.5 μm, oil absorption: 130 ml/100 g, and proportion of inorganic particles having a secondary particle diameter of 1.2-15 μm: 80% by volume) was dispersed in 400 parts of water using a homogenizer, and the dispersion was mixed with 250 parts of a 10% aqueous solution of polyvinyl alcohol (completely saponified and having a polymerization degree of 1700) to prepare a pigment layer coating solution 2 having a solid concentration of 16.7% and a pH of 6.1.

<Pigment Layer Coating Solution 3>

100 Parts of a synthetic amorphous silica (average secondary particle diameter: 4 μm, oil absorption: 250 ml/100 g, and proportion of inorganic particles having a secondary particle diameter of 1.2-15 μm: 100% by volume) was dispersed in 400 parts of water using a homogenizer, and the dispersion was mixed with 250 parts of a 10% aqueous solution of polyvinyl alcohol (completely saponified and having a polymerization degree of 1700) to prepare a pigment layer coating solution 3 having a solid concentration of 16.7% and a pH of 6.2.

<Pigment Layer Coating Solution 4>

65 parts of a synthetic amorphous silica (average secondary particle diameter: 1.2 μm, oil absorption: 180 ml/100 g) and 35 parts of a synthetic amorphous silica (average secondary particle diameter: 15 μm, oil absorption: 240 ml/100 g) were mixed so that the average secondary particle diameter of the pigment contained in the pigment layer was adjusted to 4.8 μm and the proportion of the inorganic particles having a secondary particle diameter of 1.2-15 μm was adjusted to 55% by volume of the total volume of the inorganic particles. The mixture was dispersed in 400 parts of water using a homogenizer, and the dispersion was mixed with 250 parts of a 10% aqueous solution of polyvinyl alcohol (completely saponified and having a polymerization degree of 1700) to prepare a pigment layer coating solution 4 having a solid concentration of 16.7% and a pH of 6.2. The mixture of the synthetic amorphous silica used had an oil absorption of 205 ml/100 g.

<Pigment Layer Coating Solution 5>

100 parts of a synthetic amorphous silica (average secondary particle diameter: 4 μm, oil absorption: 160 ml/100 g, and the proportion of the inorganic particles having a secondary particle diameter of 1.2-15 μm: 100% by volume) was dispersed in 400 parts of water using a homogenizer, and the dispersion was mixed with 250 parts of a 10% aqueous solution of polyvinyl alcohol (completely saponified and having a polymerization degree of 1700) to prepare a pigment layer coating solution 5 having a solid concentration of 16.7% and a pH of 5.8.

<Pigment Layer Coating Solution 6>

100 parts of a synthetic amorphous silica (average secondary particle diameter: 4 μm, oil absorption: 340 ml/100 g, and the proportion of the inorganic particles having a secondary particle diameter of 1.2-15 μm: 100% by volume) was dispersed in 400 parts of water using a homogenizer, and the dispersion was mixed with 250 parts of a 10% aqueous solution of polyvinyl alcohol (completely saponified and having a polymerization degree of 1700) to prepare a pigment layer coating solution 6 having a solid concentration of 16.7% and a pH of 6.1.

<Pigment Layer Coating Solution 7>

50 parts of a synthetic amorphous silica (average secondary particle diameter: 4 μm, oil absorption: 160 ml/100 g) and 50 parts of a synthetic amorphous silica (average secondary particle diameter: 4 μm, oil absorption: 340 ml/100 g) were mixed so that the average secondary particle diameter of the pigment contained in the pigment layer was adjusted to 4 μm and the proportion of the inorganic particles having a secondary particle diameter of 1.2-15 μm was adjusted to 100% by volume of the total volume of inorganic particles. The mixture was dispersed in 400 parts of water using a homogenizer, and the dispersion was mixed with 250 parts of a 10% aqueous solution of polyvinyl alcohol (completely saponified and having a polymerization degree of 1700) to prepare a pigment layer coating solution 7 having a solid concentration of 16.7% and a pH of 6.1. The mixture of the synthetic amorphous silica used had an oil absorption of 250 ml/100 g.

<Pigment Layer Coating Solution 8>

2 parts of sodium hydroxide and 100 parts of a synthetic amorphous silica (average secondary particle diameter: 4 μm, oil absorption: 250 ml/100 g, and proportion of the inorganic particles having a secondary particle diameter of 1.2-15 μm: 100% by volume) were dispersed in 400 parts of water using a homogenizer, and the dispersion was mixed with 250 parts of a 10% aqueous solution of polyvinyl alcohol (completely saponified and having a polymerization degree of 1700) to prepare a pigment layer coating solution 8 having a solid concentration of 16.9% and a pH of 10.5.

<Pigment Layer Coating Solution 9>

100 parts of kohaku (highly white) first class grade kaolin (average secondary particle diameter: 1.6 μm, oil absorption: 40 ml/100 g, and proportion of the inorganic particles having a secondary particle diameter of 1.2-15 μm: 80% by volume) and 0.1 part of sodium polyacrylate were dispersed in 150 parts of water using a homogenizer, and the dispersion was mixed with 250 parts of a 8% aqueous solution of oxidized starch to prepare a pigment layer coating solution 9 having a solid concentration of 24% and a pH of 9.5.

<Pigment Layer Coating Solution 10>

100 parts of precipitated calcium carbonate (average secondary particle diameter: 2.0 μm, oil absorption: 85 ml/100 g, and proportion of the inorganic particles having a secondary particle diameter of 1.2-15 μm: 65% by volume) and 0.2 part of sodium polyacrylate were dispersed in 100 parts of water using a homogenizer, and the dispersion was mixed with 42 parts (solid content) of a 48% styrene-butadiene copolymer latex to prepare a pigment layer coating solution 10 having a solid concentration of 49.7% and a pH of 9.8.

<Pigment Layer Coating Solution 11>

100 parts of a synthetic amorphous silica (average secondary particle diameter: 0.8 μm, oil absorption: 110 ml/100 g, and proportion of the inorganic particles having a secondary particle diameter of 1.2-15 μm: 20% by volume) was dispersed in 400 parts of water using a homogenizer, and the dispersion was mixed with 250 parts of a 10% aqueous solution of polyvinyl alcohol (completely saponified and having a polymerization degree of 1700) to prepare a pigment layer coating solution 11 having a solid concentration of 16.7% and a pH of 5.9.

<Pigment Layer Coating Solution 12>

100 parts of a synthetic amorphous silica (average secondary particle diameter: 20 μm, oil absorption: 230 ml/100 g, and proportion of the inorganic particles having a secondary particle diameter of 1.2-15 μm: 30% by volume) was dispersed in 400 parts of water using a homogenizer, and the dispersion was mixed with 250 parts of a 10% aqueous solution of polyvinyl alcohol (completely saponified and having a polymerization degree of 1700) to prepare a pigment layer coating solution 12 having a solid concentration of 16.7% and a pH of 5.8.

<Synthesis of Alumina Hydrate>

A synthesis example of alumina hydrate used in the ink-receiving layer is shown below. The starting materials used were all commercially available products, which were used as they were, without carrying out purification.

1200 g of ion-exchanged water and 900 g of isopropyl alcohol were charged in a reaction vessel of 3 L and heated to 75° C. Thereto was added 408 g of aluminum isopropoxide, and hydrolysis was carried out at 75° C. for 24 hours and at 95° C. for 4 hours. Thereafter, 24 g of acetic acid was added, followed by stirring at 95° C. for 40 hours, then dispersing using a serrated blade type dispersing machine, and concentrating to give a solid concentration of 16% to obtain a dispersion of white ultrafine particle alumina hydrate. The average secondary particle diameter of the alumina hydrate fine particles was 180 nm measured by a laser beam diffraction•scattering method.

The resulting sol was dried at room temperature and subjected to X-ray diffraction to show that it had a pseudoboehmite structure. Furthermore, the average primary particle diameter was measured by a transmission electron microscope to obtain about 20 nm, and the sol comprised an alumina hydrate of platy pseudoboehmite structure having an aspect ratio of 6. Moreover, BET specific surface area, average pore radius, pore volume of pores having a pore radius of 1-30 nm, and pore volume of pores having a pore radius of 2-10 nm were measured by nitrogen adsorption and desorption method to obtain 136 $m^2/g$, 5.8 nm, 0.54 ml/g and 0.50 ml/g, respectively.

<Ink-Receiving Layer Coating Solution 1>

625 parts of the above 16% dispersion of ultrafine particle alumina hydrate was mixed with 60 parts of a 10% aqueous solution of polyvinyl alcohol (having a saponification degree of 88% and a polymerization degree of 2400) and 12.5 parts of a 4% aqueous boric acid solution to prepare an ink-receiving layer coating solution 1 having a solid concentration of 15.3% and a pH of 3.9.

<Ink-Receiving Layer Coating Solution 2>

100 parts of gas phase process silica (having an average primary particle diameter of 12 nm, an average secondary particle diameter of 120 nm, a specific surface area according to BET method of 300 $m^2/g$ and a degree of dispersion of 0.3) was dispersed in 480 parts of water using a homogenizer. The dispersion was mixed with 200 parts of a 10% aqueous solution of polyvinyl alcohol (having a saponification degree of 88% and a polymerization degree of 2400) and 20 parts of a 4% aqueous boric acid solution to prepare an ink-receiving layer coating solution 2 having a solid concentration of 15.1% and a pH of 4.7.

<Ink-Receiving Layer Coating Solution 3>

625 parts of the above 16% dispersion of ultrafine particle alumina hydrate was mixed with 60 parts of a 10% aqueous solution of polyvinyl alcohol (having a saponification degree of 88% and a polymerization degree of 2400), 12.5 parts of a 4% aqueous boric acid solution and 20 parts of a 25% aqueous solution of basic polyaluminum hydroxide to prepare an ink-receiving layer coating solution 3 having a solid concentration of 15.5% and a pH of 3.5.

<Ink-Receiving Layer Coating Solution 4>

625 parts of the above 16% dispersion of ultrafine particle alumina hydrate was mixed with 60 parts of a 10% aqueous solution of polyvinyl alcohol (having a saponification degree of 88% and a polymerization degree of 2400) to prepare an ink-receiving layer coating solution 4 having a solid concentration of 15.5% and a pH of 3.9.

<Ink-Receiving Layer Coating Solution 5>

100 parts of gas phase process silica (having an average primary particle diameter of 12 nm, an average secondary particle diameter of 120 nm, a specific surface area according to BET method of 300 $m^2/g$ and a degree of dispersion of 0.3) was dispersed in 500 parts of water using a homogenizer. The dispersion was mixed with 200 parts of a 10% aqueous solution of polyvinyl alcohol (having a saponification degree of 88% and a polymerization degree of 2400), 20 parts of a 4% aqueous boric acid solution and 20 parts of a 25% aqueous solution of basic polyaluminum hydroxide to prepare an ink-receiving layer coating solution 5 having a solid concentration of 15.0% and a pH of 4.2.

<Ink-Receiving Layer Coating Solution 6>

625 parts of the above 16% dispersion of ultrafine particle alumina hydrate was mixed with 41.7 parts (solid content) of a 48% styrene-butadiene copolymer latex to prepare an ink-receiving layer coating solution 6 having a solid concentration of 17.6% and a pH of 4.1.

<Ink-Receiving Layer Coating Solution 7>

40% colloidal silica (monodispersed particles, average primary particle diameter: 80 nm) was mixed with 200 parts of a 10% aqueous solution of polyvinyl alcohol (having a saponification degree of 88% and a polymerization degree of 2400) and 10 parts of a 2% aqueous sodium borate solution to prepare an ink-receiving layer coating solution 7 having a solid concentration of 34.7% and a pH of 9.2.

Example 1

The pigment layer coating solution 1 was coated on the support 1 in an amount of 12 g/m$^2$ in terms of dry solid content by an air knife coater and dried with hot air. Then, on the resulting pigment layer was coated the ink-receiving layer coating solution 1 in an amount of 9 g/m$^2$ in terms of dry solid content by an air knife coater and dried with hot air, followed by soft-calendering treatment to obtain an ink jet recording material of Example 1.

Example 2

An ink jet recording material of Example 2 was produced under the same conditions as in Example 1, except that the pigment layer coating solution 2 was used in place of the pigment layer coating solution 1.

Example 3

An ink jet recording material of Example 3 was produced under the same conditions as in Example 1, except that the pigment layer coating solution 3 was used in place of the pigment layer coating solution 1.

Example 4

An ink jet recording material of Example 4 was produced under the same conditions as in Example 1, except that the pigment layer coating solution 4 was used in place of the pigment layer coating solution 1.

Example 5

An ink jet recording material of Example 5 was produced under the same conditions as in Example 1, except that the pigment layer coating solution 5 was used in place of the pigment layer coating solution 1.

Example 6

An ink jet recording material of Example 6 was produced under the same conditions as in Example 1, except that the pigment layer coating solution 6 was used in place of the pigment layer coating solution 1.

Example 7

An ink jet recording material of Example 7 was produced under the same conditions as in Example 1, except that the pigment layer coating solution 7 was used in place of the pigment layer coating solution 1.

Example 8

An ink jet recording material of Example 8 was produced under the same conditions as in Example 1, except that the pigment layer coating solution 8 was used in place of the pigment layer coating solution 1.

Example 9

An ink jet recording material of Example 9 was produced under the same conditions as in Example 1, except that the pigment layer coating solution 9 was used in place of the pigment layer coating solution 1.

Example 10

An ink jet recording material of Example 10 was produced under the same conditions as in Example 1, except that the pigment layer coating solution 10 was used in place of the pigment layer coating solution 1.

Example 11

An ink jet recording material of Example 11 was produced under the same conditions as in Example 1, except that the pigment layer coating solution 3 was used in place of the pigment layer coating solution 1 and the ink-receiving layer coating solution 3 was used in place of the ink-receiving layer coating solution 1.

Example 12

An ink jet recording material of Example 12 was produced under the same conditions as in Example 1, except that the pigment layer coating solution 7 was used in place of the pigment layer coating solution 1 and the ink-receiving layer coating solution 3 was used in place of the ink-receiving layer coating solution 1.

Example 13

An ink jet recording material of Example 13 was produced under the same conditions as in Example 1, except that the pigment layer coating solution 8 was used in place of the pigment layer coating solution 1 and the ink-receiving layer coating solution 2 was used in place of the ink-receiving layer coating solution 1.

Example 14

An ink jet recording material of Example 14 was produced under the same conditions as in Example 1, except that the pigment layer coating solution 8 was used in place of the pigment layer coating solution 1 and the ink-receiving layer coating solution 3 was used in place of the ink-receiving layer coating solution 1.

Example 15

An ink jet recording material of Example 15 was produced under the same conditions as in Example 1, except that the pigment layer coating solution 10 was used in place of the pigment layer coating solution 1 and the ink-receiving layer coating solution 3 was used in place of the ink-receiving layer coating solution 1.

Example 16

An ink jet recording material of Example 16 was produced under the same conditions as in Example 1, except that the pigment layer coating solution 8 was used in place of the pigment layer coating solution 1 and the ink-receiving layer coating solution 5 was used in place of the ink-receiving layer coating solution 1.

Example 17

An ink jet recording material of Example 17 was produced under the same conditions as in Example 14, except that the dry solid content of 12 g/m$^2$ of the pigment layer coating solution 8 was changed to 17.5 g/m$^2$ and the dry solid content of 9 g/m$^2$ of the ink-receiving layer coating solution 3 was changed to 3.5 g/m$^2$.

Example 18

An ink jet recording material of Example 18 was produced under the same conditions as in Example 14, except that the dry solid content of 12 g/m$^2$ of the pigment layer coating solution 8 was changed to 9.5 g/m$^2$ and the dry solid content of 9 g/m$^2$ of the ink-receiving layer coating solution 3 was changed to 11.4 g/m$^2$.

Example 19

An ink jet recording material of Example 19 was produced under the same conditions as in Example 1, except that the pigment layer coating solution 8 was used in place of the pigment layer coating solution 1 and the ink-receiving layer coating solution 7 was used in place of the ink-receiving layer coating solution 1.

Comparative Example 1

The pigment layer coating solution 8 was coated on the support 1 in an amount of 21 g/m$^2$ in terms of dry solid content by an air knife coater and dried with hot air, followed by carrying out a soft-calendering treatment to produce an ink jet recording material of Comparative Example 1.

Comparative Example 2

The ink-receiving layer coating solution 1 was coated on the support 1 in an amount of 21 g/m$^2$ in terms of dry solid content by an air knife coater and dried with hot air, followed by carrying out a soft-calendering treatment to produce an ink jet recording material of Comparative Example 2.

Comparative Example 3

An ink jet recording material of Comparative Example 3 was produced under the same conditions as in Example 1, except that the pigment layer coating solution 11 was used in place of the pigment layer coating solution 1.

Comparative Example 4

An ink jet recording material of Comparative Example 4 was produced under the same conditions as in Example 1, except that the pigment layer coating solution 12 was used in place of the pigment layer coating solution 1.

Comparative Example 5

An ink jet recording material of Comparative Example 5 was produced under the same conditions as in Example 1, except that the pigment layer coating solution 8 was used in place of the pigment layer coating solution 1 and the ink-receiving layer coating solution 4 was used in place of the ink-receiving layer coating solution 1.

Comparative Example 6

An ink jet recording material of Comparative Example 6 was produced under the same conditions as in Example 1, except that the pigment layer coating solution 11 was used in place of the pigment layer coating solution 1 and the ink-receiving layer coating solution 4 was used in place of the ink-receiving layer coating solution 1.

Comparative Example 7

An ink jet recording material of Comparative Example 7 was produced under the same conditions as in Example 1, except that the pigment layer coating solution 3 was used in place of the pigment layer coating solution 1 and the ink-receiving layer coating solution 6 was used in place of the ink-receiving layer coating solution 1.

Comparative Example 8

An ink jet recording material of Comparative Example 8 was produced under the same conditions as in Example 3, except that the dry solid content of 12 g/m$^2$ of the pigment layer coating solution 3 was changed to 18.5 g/m$^2$ and the dry solid content of 9 g/m$^2$ of the ink-receiving layer coating solution 1 was changed to 2.5 g/m$^2$.

Comparative Example 9

An ink jet recording material of Comparative Example 9 was produced under the same conditions as in Example 3, except that the dry solid content of 12 g/m$^2$ of the pigment layer coating solution 3 was changed to 8.4 g/m$^2$ and the dry solid content of 9 g/m$^2$ of the ink-receiving layer coating solution 1 was changed to 12.6 g/m$^2$.

<Evaluation>

Images were printed on the ink jet recording materials produced in Examples 1-19 and Comparative Example 1-9 by MC-10000 manufactured by Seiko Epson Co., Ltd. (using pigment inks, printer setting: MC gloss paper, Kirei) which is a printer using pigment inks, and evaluation was conducted on cracking of the surface of the ink-receiving layer and ink absorbability. The images used for evaluation were solid prints of black, cyan, magenta, yellow, blue, red and green colors and a pattern formed by providing outline characters on the colored background.

As to the surface gloss of the ink jet recording materials, 75° specular gloss of the unprinted portions of the surface of the ink-receiving layer was measured in accordance with JIS P8142. The results are shown in the column of "Gloss" in Table 1.

The cracking of the surface of the ink-receiving layer was evaluated by visual observation of the surface of the ink jet recording materials. In the results of evaluation, "good" means that no cracks were seen, "acceptable" means that a few cracks were seen, and "unacceptable" means that many cracks were seen. The results are shown in the column of "Cracking of coating layer" in Table 1.

The ink absorbability was evaluated by visual observation of evenness of the solid print portions and sharpness of the boundary of adjacent solid print portions and the white letters, and the results are shown by numerals 1-10. The numeral 1 means that the ink absorbability was the lowest, and with increase of the numeral, the ink absorbability increases, and the numeral 10 means that the ink absorbability was the highest. The results are shown in the column of "Ink absorbability" in Table 1.

The color developability was evaluated by measuring the density of the black solid print portion by a densitometer (Macbeth RD918). The larger the numerals, the better the color developability. The results are shown in the column of "Color developability" in Table 1.

TABLE 1

| Example/ Comparative Example | Gloss (%) | Cracking of coating layer | Ink absorbability | Color developability of ink |
|---|---|---|---|---|
| Example 1 | 52 | good | 5 | 2.03 |
| Example 2 | 51 | good | 6 | 2.03 |
| Example 3 | 54 | good | 8 | 2.02 |
| Example 4 | 50 | acceptable | 7 | 1.90 |
| Example 5 | 51 | good | 6 | 2.01 |
| Example 6 | 49 | acceptable | 7 | 1.98 |
| Example 7 | 54 | good | 8 | 2.05 |
| Example 8 | 60 | good | 9 | 2.10 |
| Example 9 | 50 | good | 6 | 1.88 |
| Example 10 | 48 | good | 6 | 1.87 |
| Example 11 | 55 | good | 9 | 2.10 |
| Example 12 | 52 | good | 9 | 2.12 |
| Example 13 | 42 | good | 10 | 2.01 |
| Example 14 | 61 | good | 10 | 2.15 |
| Example 15 | 46 | good | 7 | 1.96 |
| Example 16 | 45 | good | 10 | 2.05 |
| Example 17 | 42 | good | 7 | 1.98 |
| Example 18 | 60 | good | 8 | 2.15 |
| Example 19 | 45 | acceptable | 7 | 1.91 |
| Comparative Example 1 | 4 | good | 10 | 1.48 |
| Comparative Example 2 | 42 | unacceptable | 2 | 1.68 |
| Comparative Example 3 | 50 | good | 3 | 1.99 |
| Comparative Example 4 | 31 | unacceptable | 5 | 1.71 |
| Comparative Example 5 | 38 | unacceptable | 2 | 1.69 |
| Comparative Example 6 | 41 | unacceptable | 3 | 1.72 |
| Comparative Example 7 | 27 | unacceptable | 5 | 1.71 |
| Comparative Example 8 | 32 | good | 6 | 1.74 |
| Comparative Example 9 | 52 | unacceptable | 6 | 1.80 |

As shown in the results of Examples 1-19 in Table 1, the ink jet recording materials having both the pigment ink absorbability and the color developability can be obtained without causing cracking of the surface of the ink-receiving layer upon drying by heating when the average secondary particle diameter of the pigment contained in the pigment layer is not less than 1 μm and not more than 5 μm, 50% by volume or more of the total volume of the pigment particles have a secondary particle diameter of not less than 1.2 μm and not more than 15 μm, and the ink-receiving layer is formed by coating a coating solution containing at least inorganic ultrafine particles, a hydrophilic binder and boric acid on a paper support in succession so that the dry coating amount of the ink-receiving layer is not less than 20% by mass and not more than 120% by mass of the dry coating amount of the pigment layer, followed by drying the coat. Furthermore, when the oil absorption of the pigment particles is 160-320 ml/100 g, the absorbability is improved, and when the pigment layer has a pH of 8-11 and the ink-receiving layer has a pH of 3-5, the surface gloss is improved, and, moreover, separability between the colorant pigment and the solvent component in the pigment ink is improved, and thus ink jet recording materials which are further excellent in surface gloss, ink absorbability and color developability can be obtained.

In Comparative Example 1, sufficient color developability cannot be obtained because only the pigment layer is provided, and in Comparative Example 2, absorbability for pigment ink is insufficient and the coating layer is cracked when only the ink-receiving layer is used. In Comparative Example 3, the ink absorbability is insufficient because the secondary particle diameter of the pigment particles contained in the pigment layer is small, and in Comparative Example 4 where the secondary particle diameter of the pigment particles contained in the pigment layer is too large, the surface of the ink-receiving layer is cracked and the surface gloss and color developability are deteriorated. In Comparative Examples 5, 6 and 7, cracking cannot be inhibited because the ink-receiving layer contains no boric acid. In Comparative Examples 8 and 9 where the coating amounts of the pigment layer and the ink-receiving layer are outside the ranges of the present invention, the absorbability for the pigment ink and the color developability cannot be simultaneously obtained without causing occurrence of cracking on the surface of the ink-receiving layer.

<Support 2>

A mixture comprising 50 parts of LBKP and 50 parts of NBKP was beaten to a freeness of 300 ml to prepare a pulp slurry. To the slurry were added 0.5% (based on the pulp) of alkyl ketene dimmer as a sizing agent, 1.0% by mass (based on the pulp) of polyacrylamide as a paper strength additive, 2.0% (based on the pulp) of cationized starch and 0.5% (based on the pulp) of polyamide-epichlorohydrin resin, followed by diluting with water to prepare a 1% slurry. The resulting slurry was subjected to paper making process using a Fourdrinier paper machine to make a paper of 170 g/m$^2$ in basis weight, thereby obtaining a paper support. A polyethylene resin composition which was obtained by uniformly dispersing 5% of anatase type titanium in a resin of 100% low-density polyethylene having a density of 0.918 g/cm$^3$ and which was molten at 320° C. was extrusion coated on the surface of the paper support obtained above (on the side on which a pigment layer and an ink-receiving layer are to be provided) at 200 m/min so as to give a coat of 20 μm thick, followed by giving a surface gloss of 60% using a cooling roll subjected to fine surface roughening treatment to produce a support 2 having no gas permeability and no ink solvent absorbability.

<Pigment Layer Coating Solution 13>

100 parts of a synthetic amorphous silica (average secondary particle diameter: 2.3 μm, oil absorption: 220 ml/100 g, and proportion of the inorganic particles having a secondary particle diameter of 1.2-15 μm: 90% by volume) was dispersed in 400 parts of water using a homogenizer, and the dispersion was mixed with 250 parts of a 10% aqueous solution of polyvinyl alcohol (completely saponified and having a polymerization degree of 1700), 30 parts of a 50% ethylene-vinyl acetate copolymer latex, 0.3 part of a surface active agent and water to prepare a pigment layer coating solution 13 having a solid concentration of 18.0% and a pH of 6.8.

<Pigment Layer Coating Solution 14>

A coating solution was prepared in the same manner as in preparation of the pigment layer coating solution 13, except that the pigment was changed to a synthetic amorphous silica (average secondary particle diameter: 1.2 μm, oil absorption: 180 ml/100 g, and proportion of the inorganic particles having a secondary particle diameter of 1.2-15 μm: 50% by volume). The resulting coating solution had a pH of 6.6.

<Pigment Layer Coating Solution 15>

A coating solution was prepared in the same manner as in preparation of the pigment layer coating solution 13, except that the pigment was changed to a synthetic amorphous silica (average secondary particle diameter: 4.3 μm, oil absorption: 260 ml/100 g, and proportion of the inorganic particles having a secondary particle diameter of 1.2-15 μm: 100% by volume). The resulting coating solution had a pH of 6.5.

<Pigment Layer Coating Solution 16>

100 parts of precipitated calcium carbonate (average secondary particle diameter: 2.5 μm, oil absorption: 90 ml/100 g, and proportion of the inorganic particles having a secondary particle diameter of 1.2-15 μm: 70% by volume) was dispersed in 100 parts of water using a homogenizer, and the dispersion was mixed with 42 parts of a 48% styrene-butadiene copolymer latex, 50 parts of a 8% aqueous oxidized starch solution and 0.3 part of a surface active agent to prepare a pigment layer coating solution 16 having a solid concentration of 42.5% and a pH of 9.6.

<Pigment Layer Coating Solution 17>

A coating solution was prepared in the same manner as in preparation of the pigment layer coating solution 13, except that the pigment was changed to a synthetic amorphous silica (average secondary particle diameter: 0.8 μm, oil absorption: 110 ml/100 g, and proportion of the inorganic particles having a secondary particle diameter of 1.2-15 μm: 20% by volume). The resulting coating solution had a pH of 6.5.

<Pigment Layer Coating Solution 18>

A coating solution was prepared in the same manner as in preparation of the pigment layer coating solution 13, except that the pigment was changed to a synthetic amorphous silica (average secondary particle diameter: 6.0 μm, oil absorption: 220 ml/100 g, and proportion of the inorganic particles having a secondary particle diameter of 1.2-15 μm: 100% by volume). The resulting coating solution had a pH of 6.7.

<Ink-Receiving Layer Coating Solution 8>

To 400 parts of water were added 8 parts of a 50% dimethyldiallylammonium chloride homopolymer (molecular weight: 9,000) and 100 parts of gas phase process silica (having an average primary particle diameter of 20 nm and a specific surface area according to BET method of 90 $m^2/g$), and a preliminary dispersion was prepared using a serrated blade type dispersing machine. The resulting preliminary dispersion was treated by a high pressure homogenizer to obtain a 20.5% silica dispersion. 500 parts of the resulting silica dispersion, 20 parts of a 4% aqueous boric acid solution, 250 parts of 8% polyvinyl alcohol (having a saponification degree of 88% and an average polymerization degree of 3500), 0.3 part of a surface active agent, and 54 parts of water were mixed to prepare an ink-receiving layer coating solution 8 having a solid concentration of 15.0% and a pH of 4.1. The average secondary particle diameter of the gas phase process silica fine particles was 500 nm measured by laser beam diffraction-scattering method.

<Ink-Receiving Layer Coating Solution 9>

A coating solution was prepared in the same manner as in preparation of the ink-receiving layer coating solution 8, except that the gas phase process silica was changed to a gas phase process silica having an average primary particle diameter of 16 nm and a specific surface area according to BET method of 130 $m^2/g$. The resulting coating solution had a pH of 4.2. The average secondary particle diameter of the gas phase process silica fine particles was 400 nm measured by laser beam diffraction-scattering method.

<Ink-Receiving Layer Coating Solution 10>

A coating solution was prepared in the same manner as in preparation of the ink-receiving layer coating solution 8, except that the gas phase process silica was changed to a gas phase process silica having an average primary particle diameter of 30 nm and a specific surface area according to BET method of 50 $m^2/g$. The resulting coating solution had a pH of 4.1. The average secondary particle diameter of the gas phase process silica fine particles was 500 nm measured by laser beam diffraction•scattering method.

<Ink-Receiving Layer Coating Solution 11>

A coating solution was prepared in the same manner as in preparation of the ink-receiving layer coating solution 8, except that the gas phase process silica was changed to a gas phase process silica having an average primary particle diameter of 12 nm and a specific surface area according to BET method of 200 $m^2/g$. The resulting coating solution had a pH of 4.3. The average secondary particle diameter of the gas phase process silica fine particles was 350 nm measured by laser beam diffraction•scattering method.

<Ink-Receiving Layer Coating Solution 12>

To 240 parts of water were added 8 parts of a 50% dimethyldiallylammonium chloride homopolymer (molecular weight: 9,000) and 100 parts of precipitation process silica (having a specific surface area according to BET method of 130 $m^2/g$, an average primary particle diameter of 16 nm and an average agglomeration particle diameter of 6 μm), and a preliminary dispersion was prepared using a serrated blade type dispersing machine. The resulting preliminary dispersion was treated by a beads mill to obtain a silica dispersion of 29.9% in solid concentration. 335 parts of the resulting silica dispersion, 20 parts of a 4% aqueous boric acid solution, 250 parts of 8% polyvinyl alcohol (having a saponification degree of 88% and an average polymerization degree of 3500), 0.3 part of a surface active agent, and 203 parts of water were mixed to prepare an ink-receiving layer coating solution 12 having a solid concentration of 15.0% and a pH of 4.3. The average secondary particle diameter of the silica fine particles was 400 nm measured by laser beam diffraction•scattering method.

<Ink-Receiving Layer Coating Solution 13>

To 400 parts of water were added 2 parts of 60% nitric acid and 100 parts of an alumina hydrate having pseudoboehmite structure (having an average primary particle diameter of 15 nm and a specific surface area according to BET method of 160 $m^2/g$), and an alumina hydrate dispersion of 20.2% was prepared using a serrated blade type dispersing machine. 500 parts of the resulting alumina hydrate dispersion, 10 parts of a 4% aqueous boric acid solution, 100 parts of 8% polyvinyl alcohol (having a saponification degree of 88% and an average polymerization degree of 3500), 40 parts of a 25% aqueous solution of basic polyaluminum hydroxide, 0.3 part of a surface active agent, and 54 parts of water were mixed to prepare an ink-receiving layer coating solution 13 having a solid concentration of 17.0% and a pH of 3.1. The average secondary particle diameter of the alumina hydrate fine particles was 150 nm measured by laser beam diffraction•scattering method.

<Ink-Receiving Layer Coating Solution 14>

A coating solution was prepared in the same manner as in preparation of the ink-receiving layer coating solution 13, except that boric acid was not used. The resulting coating solution had a pH of 3.1.

Example 20

The pigment layer coating solution 13 was coated on the support 1 in a dry coating amount of 7 g/m$^2$ by an air knife coater and dried. The sheet after coated with the pigment layer had a gas permeability (specified in JIS P8117) of 120 seconds. On the resulting pigment layer was coated the ink-receiving layer coating solution 8 as a first ink-receiving layer in a dry coating amount of 7 g/m$^2$ by an air knife coater and dried. Then, on the ink-receiving layer was coated the ink-receiving layer coating solution 13 as a second ink-receiving layer in a dry coating amount of 8 g/m$^2$ by an air knife coater and dried to obtain an ink jet recording material of Example 20.

Example 21

An ink jet recording material of Example 21 was produced under the same conditions as in Example 20, except that the pigment layer coating solution 14 was used in place of the pigment layer coating solution 13. The sheet after coated with the pigment layer had a gas permeability (specified in JIS P8117) of 150 seconds.

Example 22

An ink jet recording material of Example 22 was produced under the same conditions as in Example 20, except that the pigment layer coating solution 15 was used in place of the pigment layer coating solution 13. The sheet after coated with the pigment layer had a gas permeability (specified in JIS P8117) of 80 seconds.

Example 23

An ink jet recording material of Example 23 was produced under the same conditions as in Example 20, except that the pigment layer coating solution 16 was used in place of the pigment layer coating solution 13. The sheet after coated with the pigment layer had a gas permeability (specified in JIS P8117) of 270 seconds.

Example 24

An ink jet recording material of Example 24 was produced under the same conditions as in Example 20, except that the ink-receiving layer coating solution 9 was used in place of the ink-receiving layer coating solution 8 for coating the first ink-receiving layer.

Example 25

An ink jet recording material of Example 25 was produced under the same conditions as in Example 20, except that the ink-receiving layer coating solution 10 was used in place of the ink-receiving layer coating solution 8 for coating the first ink-receiving layer.

Example 26

An ink jet recording material of Example 26 was produced under the same conditions as in Example 20, except that the ink-receiving layer coating solution 11 was used in place of the ink-receiving layer coating solution 8 for coating the first ink-receiving layer.

Example 27

An ink jet recording material of Example 27 was produced under the same conditions as in Example 20, except that the ink-receiving layer coating solution 12 was used in place of the ink-receiving layer coating solution 8 for coating the first ink-receiving layer.

Example 28

An ink jet recording material of Example 28 was produced under the same conditions as in Example 20, except that the ink-receiving layer coating solution 14 was used in place of the ink-receiving layer coating solution 13 for coating the second ink-receiving layer.

Example 29

An ink jet recording material of Example 29 was produced under the same conditions as in Example 20, except that a soft-calendering treatment was carried out after coating the second ink-receiving layer and drying the coat.

Comparative Example 10

The ink-receiving layer coating solution 8 as a first ink-receiving layer was coated on the support 1 in a dry coating amount of 11 g/m$^2$ by an air knife coater and dried. Then, on the ink-receiving layer was coated the ink-receiving layer coating solution 13 as a second ink-receiving layer in a dry coating amount of 11 g/m$^2$ by an air knife coater and dried to obtain an ink jet recording material of Comparative Example 10.

Comparative Example 11

An ink jet recording material of Comparative Example 11 was produced under the same conditions as in Example 20, except that the pigment layer coating solution 17 was used in place of the pigment layer coating solution 13. The sheet after coated with the pigment layer had a gas permeability (specified in JIS P8117) of 180 seconds.

Comparative Example 12

An ink jet recording material of Comparative Example 12 was produced under the same conditions as in Example 20, except that the pigment layer coating solution 18 was used in place of the pigment layer coating solution 13. The sheet after coated with the pigment layer had a gas permeability specified in JIS P8117 of 60 seconds.

Comparative Example 13

An ink jet recording material of Comparative Example 13 was produced under the same conditions as in Example 20, except that the support 2 was used in place of the support 1.

Comparative Example 14

The pigment layer coating solution 13 was coated on the support 1 in a dry coating amount of 7 g/m$^2$ by an air knife coater and dried. On the resulting pigment layer was coated the ink-receiving layer coating solution 13 as an ink-receiving layer in a dry coating amount of 15 g/m$^2$ by an air knife coater and dried to obtain an ink jet recording material of Comparative Example 14.

<Evaluation>

75° specular gloss (specified in JIS P8142) of the surface of the ink-receiving layer of the ink jet recording materials produced in Examples 20-29 and Comparative Examples 10-14 was measured, and the results are shown in the column of "Gloss" in Table 2.

With reference to the cracking of the surface of the ink-receiving layer, the surface of the ink jet recording materials was observed in the state of the first ink-receiving layer being provided and in the state of the second ink-receiving layer being provided. Black solid images were printed on the surface of the ink-receiving layer of the respective sheets using MC-10000 manufactured by Seiko Epson Co., Ltd. (using pigment ink, printer setting: MC gloss paper, Kirei). The degree of cracking on the surface of the coating layer was evaluated by observing the printed portions with an optical microscope and shown by the numerals of 1-5 according to the following criteria. The criterion 3 or more means practically acceptable level. The results are shown in the column of "Cracking of coating layer" in Table 2.

5: No cracks are seen.

4: Some small cracks are seen.

3: There are somewhat large cracks, which cannot be recognized with the naked eye.

2: There are large cracks, which can be recognized when they are carefully looked at.

1: The cracks can be clearly recognized with the naked eye.

Solid print images of black, cyan, magenta and yellow colors were printed on the ink jet recording materials produced above by MC-10000 manufactured by Seiko Epson Co., Ltd. (using pigment inks, printer setting: MC gloss paper, Kirei), and evaluation was conducted on image density and ink absorbability. The density of the black solid print images was measured by a densitometer (Macbeth RD918). The greater numerals mean better ink absorbability. The results are shown in the column of "Color developability of ink" in Table 2. The ink absorbability of the print images was visually evaluated. The ink absorbability is shown by the numerals of 1-5 according to the following criteria. The criterion 3 or more means practically acceptable level. The results are shown in the column of "Ink absorbability" in Table 2.

5: There is no bleeding in the boundary portion between the respective colors, and uniform color development is obtained with all inks.

4: The boundary portion is somewhat bled, but uniform color development is obtained with all inks.

3: The boundary portion is bled, but uniform color development is obtained with all inks.

2: The boundary portion is evidently bled, and color development is not uniform with a part of the inks.

1: The ink overflows with inferior absorbability.

TABLE 2

| Example/ Comparative Example | Gloss (%) | Cracking of coating layer: The first ink-receiving layer | Cracking of coating layer: The second ink-receiving layer | Ink absorb-ability | Color develop-ability of ink |
|---|---|---|---|---|---|
| Example 20 | 72 | 5 | 5 | 5 | 2.17 |
| Example 21 | 73 | 5 | 5 | 5 | 2.17 |
| Example 22 | 70 | 4 | 4 | 5 | 2.14 |
| Example 23 | 73 | 5 | 5 | 4 | 2.15 |
| Example 24 | 72 | 5 | 5 | 5 | 2.15 |
| Example 25 | 71 | 5 | 5 | 5 | 2.14 |
| Example 26 | 69 | 4 | 3 | 4 | 2.10 |
| Example 27 | 67 | 4 | 3 | 4 | 2.08 |
| Example 28 | 70 | 5 | 3 | 4 | 2.07 |
| Example 29 | 79 | 5 | 5 | 4 | 2.19 |
| Comparative Example 10 | 63 | 2 | 1 | 3 | 1.85 |
| Comparative Example 11 | 70 | 3 | 2 | 2 | 1.88 |
| Comparative Example 12 | 65 | 2 | 1 | 3 | 1.86 |
| Comparative Example 13 | 66 | 4 | 1 | 1 | 1.83 |
| Comparative Example 14 | 54 | 1 | — | 2 | 1.86 |

As shown in the results of Examples 20-29 in Table 2, ink jet recording materials high in surface gloss and having both the high pigment ink absorbability and the high color developability can be obtained without causing cracking of the surface of the ink-receiving layer by successively coating on a paper support a pigment layer in which the pigment contained has an average secondary particle diameter of not less than 1 μm and not more than 5 μm and 50% by volume or more of the total volume of the pigment has a secondary particle diameter of not less than 1.2 μm and not more than 15 μm, a first ink-receiving layer containing a gas phase process silica or a wet process silica ground to 500 nm or less in average secondary particle diameter, a hydrophilic binder and boric acid, the dry coating amount of the first ink-receiving layer being not less than 20% by mass and not more than 120% by mass of the dry coating amount of the pigment layer, and a second ink-receiving layer containing an alumina hydrate. It can be seen from comparison of Examples 24 and 27 that when the inorganic ultrafine particles used in the first ink-receiving layer comprise gas phase process silica, there occurs no cracking of the surface of the ink-receiving layer and use of the gas phase process silica is preferred from the points of the surface gloss and the pigment ink absorbability and the color developability. From the comparison of Examples 20 and 24-26, it can be seen that cracking of the surface of the ink-receiving layer does not occur and the surface gloss, the pigment ink absorbability and the color developability are high in Examples 20, 24 and 25 where the specific surface area according to BET method of the gas phase process silica used in the first ink-receiving layer is smaller than the specific surface area according to BET method of the alumina hydrate used in the second ink-receiving layer. Thus, the ink jet recording materials of Examples 20, 24 and 25 are preferred. From the comparison of Examples 20 and 28, it can be seen that when at least one ink-receiving layer other than the first ink-receiving layer contains boric acid or a borate, cracking of the coating layer decreases and color developability of the images is satisfactory and thus the ink-jet recording material of Example 20 is preferred.

In Comparative Example 10 where the pigment layer is not provided, in Comparative Example 11 where the pigment used in the pigment layer has an average secondary particle diameter of less than 1 μm and in Comparative Example 12 where the pigment used in the pigment layer has an average secondary particle diameter of more than 5 μm, cracking occurs in the ink-receiving layer and color developability of the pigment ink is deteriorated. In Comparative Example 13 where the support used has no gas permeability and no ink-solvent absorbability, when the second ink-receiving layer is provided, air in the first ink-receiving layer does not escape through the support and escapes from the surface of the second ink-receiving layer, and hence defects are caused on the surface of the ink-receiving layer due to the escape of bubbles, which results in cracking of the coating layer. Further, ink absorbability is also insufficient. In Comparative Example 14 where the coating amounts of the pigment layer and the ink-receiving layer are outside the ranges of the present invention, cracking of the coating layer occurs and color developability of images is also deteriorated.

INDUSTRIAL APPLICABILITY

From the results in the above examples, it is clear that the present invention can provide ink jet recording materials which are excellent in surface gloss, have no cracks on the surface of the ink-receiving layer and has both the color developability and the absorbability of pigment ink.

The invention claimed is:

1. An ink jet recording material formed by coating a coating solution of a pigment layer and a coating solution of at least one ink-receiving layer in succession on at least one side of a paper support and drying the resulting coating layers, wherein the pigment contained in the pigment layer has an average secondary particle diameter of not less than 1 μm and not more than 5 μm, 50% by volume or more of the total volume of the pigment has a secondary particle diameter of not less than 1.2 μm and not more than 15 μm, a first ink-receiving layer directly coated on the pigment layer contains at least inorganic ultrafine particles, a hydrophilic binder and boric acid or a borate, and the dry coating amount of the first ink-receiving layer is not less than 20% by mass and not more than 120% by mass of the dry coating amount of the pigment layer, wherein the inorganic ultrafine particles contained in the first ink-receiving layer are an alumina hydrate, and wherein a second ink-receiving layer coated on the first ink-receiving layer contains an alumina hydrate as inorganic ultrafine particles.

2. An inkjet recording material according to claim 1, wherein the pigment has an oil absorption represented by JIS K5101 of not less than 160 ml/100 g and not more than 320 ml/100 g.

3. An inkjet recording material according to claim 1, wherein the coating solution of the pigment layer has a pH of not less than 8 and not more than 11, and the coating solution of the first ink-receiving layer has a pH of not less than 3 and not more than 5.

4. An inkjet recording material according to claim 1, wherein at least one ink-receiving layer contains a basic polyaluminum hydroxide.

5. An ink jet recording material according to claim 1, wherein at least one ink-receiving layer other than the first ink-receiving layer contains boric acid or a borate.

6. An inkjet recording material according to claim 1 which has a 75° specular gloss specified in JIS P8142 of not less than 55% and not more than 80%.

7. An inkjet recording material according to claim 1, wherein the gas permeability in the state of the pigment layer provided on the paper support is 30 to 1,000 seconds.

8. An ink jet recording material according to claim 2, wherein the gas permeability in the state of the pigment layer provided on the paper support is 30 to 1,000 seconds.

9. An ink jet recording material formed by coating a coating solution of a pigment layer and a coating solution of at least one ink-receiving layer in succession on at least one side of a paper support and drying the resulting coating layers, wherein the pigment contained in the pigment layer has an average secondary particle diameter of not less than 1 μm and not more than 5 μm, 50% by volume or more of the total volume of the pigment has a secondary particle diameter of not less than 1.2 μm and not more than 15 μm, a first ink-receiving layer directly coated on the pigment layer contains at least inorganic ultrafine particles, a hydrophilic binder and boric acid or a borate, and the dry coating amount of the first ink-receiving layer is not less than 20% by mass and not more than 120% by mass of the dry coating amount of the pigment layer, wherein the inorganic ultrafine particles contained in the first ink-receiving layer are a gas phase process silica and/or a wet process silica which is ground until the average secondary particle diameter reaches not more than 500 nm, and wherein a second ink-receiving layer coated on the first ink-receiving layer contains an alumina hydrate as inorganic ultrafine particles.

10. An inkjet recording material according to claim 9, wherein the gas phase process silica or wet process silica contained in the first ink-receiving layer has a specific surface area according to BET method which is smaller than that of the alumina hydrate contained in the second ink-receiving layer.

11. An inkjet recording material according to claim 9, wherein the pigment has an oil absorption represented by JIS K5101 of not less than 160 ml/100 g and not more than 320 ml/100 g.

12. An ink jet recording material according to claim 9, wherein the coating solution of the pigment layer has a pH of not less than 8 and not more than 11, and the coating solution of the first ink-receiving layer has a pH of not less than 3 and not more than 5.

13. An ink jet recording material according to claim 9, wherein at least one ink-receiving layer contains a basic polyaluminum hydroxide.

14. An inkjet recording material according to claim 9, wherein at least one ink-receiving layer other than the first ink-receiving layer contains boric acid or a borate.

15. An inkjet recording material according to claim 9, which has a 75° specular gloss specified in JIS P8142 of not less than 55% and not more than 80%.

16. An inkjet recording material according to claim 9, wherein the gas permeability in the state of the pigment layer provided on the paper support is 30 to 1,000 seconds.

17. An ink jet recording material according to claim 11, wherein the gas permeability in the state of the pigment layer provided on the paper support is 30 to 1,000 seconds.

* * * * *